United States Patent [19]

Nordenson

[11] 3,999,883

[45] Dec. 28, 1976

[54] VARIABLE TURBOMACHINE STATOR

[75] Inventor: Gary E. Nordenson, Mount Clemens, Mich.

[73] Assignee: General Motors Corporation, Detroit, Mich.

[22] Filed: July 2, 1975

[21] Appl. No.: 592,648

[52] U.S. Cl. ..... 415/113; 415/160; 415/171

[51] Int. Cl.[2] ..... F01D 11/00

[58] Field of Search ..... 415/113, 149, 160, 151, 415/172 A, 171, 170

[56] References Cited

UNITED STATES PATENTS

| | | | |
|---|---|---|---|
| 1,857,961 | 5/1932 | Lamb | 415/172 A |
| 3,647,311 | 3/1972 | Wootton et al. | 415/113 |
| 3,904,309 | 9/1975 | Keetley | 415/160 |

FOREIGN PATENTS OR APPLICATIONS

| | | | |
|---|---|---|---|
| 1,231,457 | 5/1971 | United Kingdom | 415/172 A |

*Primary Examiner*—Henry F. Raduazo
*Attorney, Agent, or Firm*—Paul Fitzpatrick

[57] ABSTRACT

A turbine nozzle has a row of vanes each rotatable about an axis extending spanwise of the vane. Each vane is rotated by a shaft which extends through one shroud of the stator vane stage. The free end of each vane is sealed by a flexible seal ring structure made up of overlapping flexible leaves. These leaves are fixed to the nozzle inner shroud at the downstream side of the vanes and motive fluid under pressure is admitted upstream of the vanes to the space between the leaves and the shroud so that the pressure difference across the leaves biases them into engagement with the ends of the vanes. The purpose is to seal against leakage past the vane ends without causing undue frictional resistance to varying the vane setting angle.

5 Claims, 4 Drawing Figures

VARIABLE TURBOMACHINE STATOR

My invention is directed to a variable setting angle stator vane structure for turbomachines such as a turbine or a dynamic compressor. In its preferred embodiment, the invention is employed in a turbine nozzle in a gas turbine engine.

It is well known that variable stators are useful to improve performance or flexibility of devices such as axialflow compressors and turbines. In turbines, variable setting stators may be employed to alter the flow capacity of the engine, to facilitate starting, and to reverse the flow against the turbine rotor for braking the output shaft. Many structures for such purposes are known. See, for example, U.S. Pat. to Buckland, No. 2,651,496, Sept. 8, 1953; Mason, No. 3,542,484, Nov. 24, 1970; and Nickles, No. 3,788,763, Jan. 29, 1974. A variable stator stage according to my invention is characterized by an annular seal engaging an end of the vanes and biased against the vanes by pressure differences existing within the stator stage so as to be held in contact with the ends of the vanes to minimize leakage while controlling the force exerted by the seal on the vane ends so as to avoid undue friction resisting changing the vane setting angle.

The principal objects of my invention are to improve the flexibility and utility of gas turbine engines, to provide an improved variable setting turbine or compressor stator stage, and to provide improved sealing means to minimize leakage past the vanes in a variable turbomachine stator stage.

The nature of my invention and its advantages will be clear to those skilled in the art from the succeeding detailed description of the preferred embodiment of the invention, the accompanying drawings thereof, and the appended claims.

Referring to the drawings.

Figure 1:
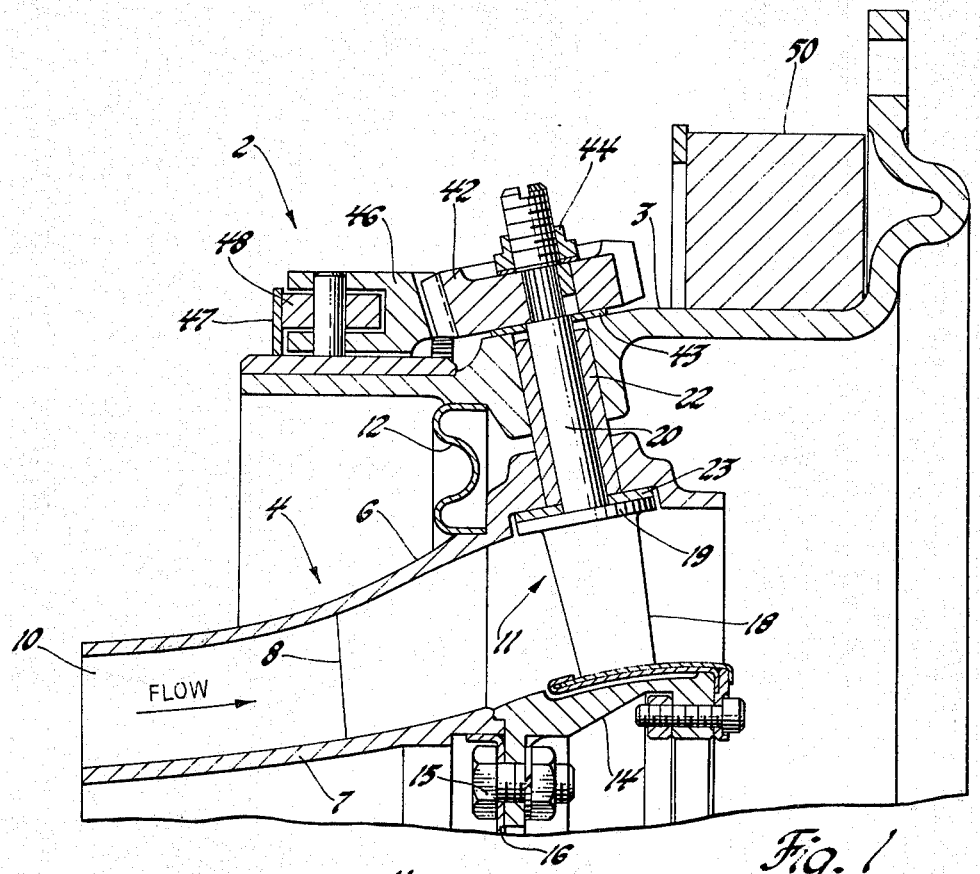
FIG. 1 is a sectional view of a turbine nozzle assembly taken in a plane containing the axis of rotation of the turbine.

The turbine nozzle assembly 2 illustrated in FIG. 1 comprises an annular outer casing section or case ring 3, this being joined to other sections of the engine casing (not illustrated). A turbine inlet duct 4 is defined by an annular outer shroud 6, an annular inner shroud 7, and circumferentially spaced struts 8 joining the shrouds. The shrouds define between them a passage 10 for flow of motive fluid into a turbine. Specifically, in the structure here illustrated, the duct 10 leads from the high pressure or gas generator turbine of an engine (not illustrated) into the low pressure or power output turbine of the engine. The flow is guided into the turbine rotor (not illustrated) by an annular cascade of variable setting nozzle vanes 11 which extend across the passage 10. The outer shroud 6 is fixed to the casing section 3 through a flexible support ring 12 which may be welded to both.

The vanes extend from the outer shroud 6, in which they are supported, into proximity to an inner shroud ring 14 which constitutes a continuation of the shroud 7 and defines the inner boundary of the flow path through the vanes. The shroud ring 14 is fixed by a ring of bolts 15 to a diaphragm 16 which closes the passage through the interior of inner shroud 7. This diaphragm is fixed to the shroud 7. Each vane 11 includes an airfoil or flow-directing portion 18, a circular platform 19 at the supported end of the airfoil, and a shaft 20 rigid with the airfoil extending through the shroud 6 and casing section 3. The shaft 20 is supported in a bushing 22 fitted in aligned holes in the casing 3 and shroud 6. A washer 23 which acts to reduce friction and leakage is disposed within a recess in the shroud abutting the outer surface of platform 19.

Figure 2:
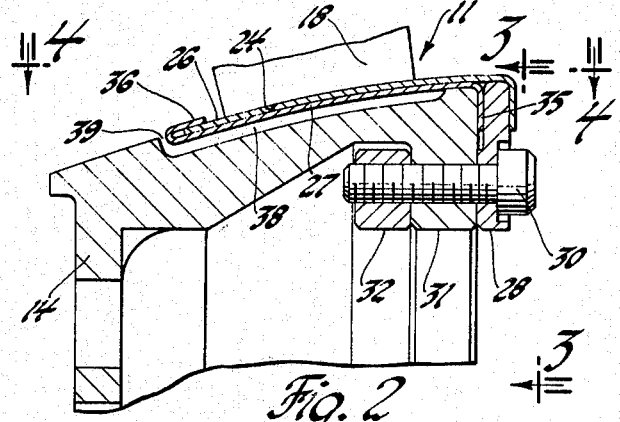
FIG. 2 is an enlarged view of a portion of FIG. 1.
Figure 3:
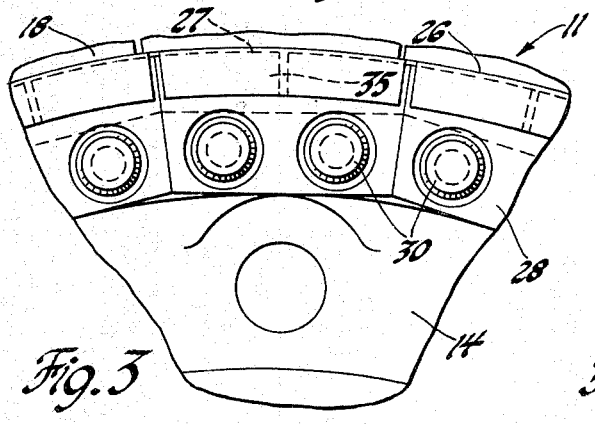
FIG. 3 is a fragmentary cross sectional view taken on the plane indicated by the line 3—3 in FIG. 2.
Figure 4:
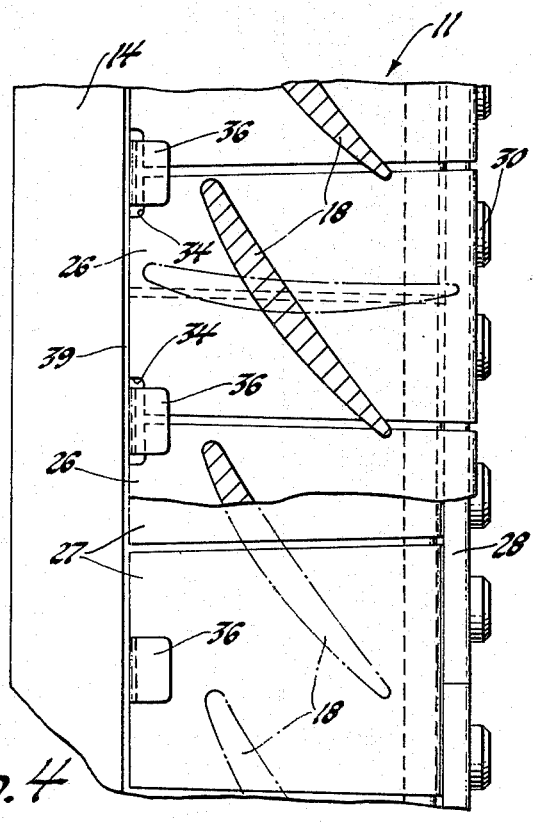
FIG. 4 is a fragmentary cross sectional view taken on the plane indicated by the line 4—4 in FIG. 2.

Referring now also to FIGS. 2 through 4, we may proceed with a description of the seal means which is in engagement with the free end 24 of each vane. The seal means is an annular structure composed of two sets of overlapping flexible leaves fixed to the inner shroud ring 14. These leaves may be described as outer seal leaves 26 which engage the vanes and inner seal leaves 27 which are disposed in overlapping staggered relation to, and in contact with, the outer leaves. In order to assure flexibility of the seal means, the leaves are of relatively small extent circumferentially of the turbine and, as illustrated, there is one outer leaf roughly centered at the axis of rotation of each vane which is the continuation of the axis of shaft 20. Each leaf 26 is high-temperature brazed to a corresponding mounting plate 28. Each mounting plate is fixed to the downstream face of shroud ring 14 by two cap screws 30 which extend through holes in a flange 31 of shroud ring 14. These cap screws are threaded into plates 32 bearing against the forward surface of flange 31 so that the mounting plate 28 is held rigidly against the downstream face of the shroud ring. As will be apparent from the drawings, leaf 26 is generally rectilinear in outline with a flanged brazed to the downstream face of the mounting plate 28 and with a notch 34 in each upstream corner of the leaf.

The inner leaves 27 are staggered with respect to the outer leaf 26. As will be apparent from the drawings, the inner leaf has a flange 35 which is clamped between the forward face of two of the mounting plates 28 and the rear face of the shroud ring 14. Leaves 27 are of essentially rectangular outline and each such leaf includes a rebent tab 36 which extends through the notches 34 and overlies an upstream corner of two outer leaves 26. This arrangement constrains the leaves 26 and 27 to remain in contact with each other and to bend or flex concurrently.

Normally, the leaves 26 are in engagement with the free end 24 of the vanes. The surface of shroud ring 14 underlying the leaves is recessed so as to lie clear of the leaves which engage the ring only adjacent their mounting point downstream of the vanes 18. The space 38 between the inner leaves and the shroud ring 14 is pressurized by motive fluid which enters the space 38 through a gap 39 at the upstream end of the leaves. Since the motive fluid is accelerated as it passes between the vanes 18, its pressure diminishes. Therefore, the pressure over the outer surface of the seal assembly; that is, the surface engaging the vanes, is less than that within the space 38 and the flexible seal leaves are biased against and into contact with the ends of the vanes. Preferably, the leaves are formed so as to define a generally spherical surface and the ends of the vanes are finished to conform to this surface so that there is full contact from leading to trailing edge of the vanes between the end of the vane and the seal. It is possible, however, for the surface of the outer seal leaf to be plane and the end of the vane likewise to be plane.

The stiffness of the leaves will, of course, be calculated or be determined by experiment to give satisfactory results. With too stiff seal leaves, the contact might not be satisfactory and, if they are too thin and flexible there would be a tendency for them to balloon up between the vanes, which would be undesirable. In a particular example in a small turbine in which the shroud ring is about 16 centimeters in diameter, leaves 26 and 27 are made from stainless steel stock approximately 0.13 millimeters thick.

My invention is not concerned with the arrangement for rotating the vanes to adjust their setting, but that shown may be described briefly. A gear 42 keyed to each shaft 20 bears against a washer 43 and is held in place by a nut 44. The gears 42 engage a toothed ring 46 rotatable about the axis of the turbine. As illustrated, the ring is guided by a flange 47 on the case 3, which is engaged by rollers 48 on ring 46. Any suitable means for rotating the ring 46 may be provided.

The drawing also illustrates a heavy containment ring 50 for the engine which is provided to contain the turbine rotor in case it should break from overspeed.

As is apparent, the principles of the invention are applicable to compressor stator stages. Since in a compressor the pressure rises going through the stage, the seal leaves should be fixed upstream of the vanes and the pressure to bias the leaves against the vanes should be taken downstream of the vanes.

While I prefer to have cantilevered vanes, my invention is applicable to variable vanes having a pivot on the shroud underlying the seal. In this case, the leaves will be punched or notched for the pivot, and the end of the airfoil should cover the hole in the outer leaf.

The utility of my invention in preventing leakage across the ends of the vanes which is inimical to efficiency of the turbine and compressor will be clear to those skilled in the art. The simplicity and self-adjusting character of the structure make it highly suitable for its intended purpose.

The detailed description of the preferred embodiment of the invention for the purpose of explaining the principles thereof is not to be considered as limiting or restricting the invention, since many modifications may be made by the exercise of skill in the art.

I claim:

1. A variable-setting stator vane stage for a turbomachine comprising, in combination, shroud means defined by first and second annular shrouds having between them an annular gas flow path; an annular cascade of stator vanes extending across the said flow path, each vane being pivotally mounted on the shroud means for rotation about an axis extending spanwise of the vane; and yieldable pressurized seal means mounted on one of said shrouds for rubbing engagement with the proximate end of each vane, the seal means comprising an annular row of outer flexible seal leaves disposed in contact with the vanes in the path; an annular row of inner flexible seal leaves in face-to-face contact with the outer seal leaves, the lateral margins of the leaves of the two said rows being out of register; means fixing one end of the seal leaves of both sets to the one said shroud at the lower pressure side of the stator stage, with the inner leaves extending clear of the one said shroud from the fixing means; and means for conducting gas from the flow path at the higher pressure side of the stator stage between the said one shroud and the leaves so as to bias the leaves against the ends of the vanes.

2. A vane stage as recited in claim 1 in which the static pressure of the gas in the flow path decreases through the stage.

3. A vane stage as recited in claim 1 in which the static pressure of the gas in the flow path increases through the stage.

4. A variable-setting stator vane stage for a turbomachine comprising, in combination, shroud means defined by first and second annular shrouds having between them an annular gas flow path; an annular cascade of stator vanes extending across the said flow path, each vane being pivotally mounted on the first said shroud for rotation about an axis extending spanwise of the vane; each of said vanes having a free end; and yieldable pressurized seal means mounted on the other said shroud inboard of said flow path for rubbing engagement with the free end of each vane, the seal means comprising an annular row of outer flexible seal leaves disposed in contact with the vanes; an annular row of inner flexible seal leaves in face-to-face contact with the outer seal leaves, the lateral margins of the leaves of the two said rows being out of register; means fixing one end of the seal leaves of both sets to the one said shroud at the lower pressure side of the stator stage, with the inner leaves extending clear of the one said shroud from the fixing means; and means for conducting gas from the flow path at the higher pressure side of the stator stage between the said one shroud and the leaves so as to bias the leaves against the ends of the vanes.

5. A variable-setting stator vane stage for a turbomachine comprising, in combination, shroud means defined by first and second annular shrouds having between them an annular gas flow path; an annular cascade of stator vanes extending across the said flow path, each vane being pivotally mounted on the shroud means for rotation about an axis extending spanwise of the vane; and yieldable pressurized seal means mounted on one said shroud in said path for rubbing engagement with the proximate end of each vane, the seal means comprising an annular row of outer flexible seal leaves disposed in contact with the vanes; an annular row of inner flexible seal leaves in face-to-face contact with the outer seal leaves, the lateral margins of the leaves of the two said rows being out of register; means fixing one end of the seal leaves of both sets to the one said shroud at the lower pressure side of the stator stage, with the inner leaves extending clear of the one said shroud from the fixing means; means providing a connection between leaves of the two said rows at the free ends of the leaves constraining the leaves of the two sets to flux in unison; and means for conducting gas from the flow path at the higher pressure side of the stator stage between the said one shroud and the leaves so as to bias the leaves against the ends of the vanes.

* * * * *